US009869006B2

(12) United States Patent
Wu et al.

(10) Patent No.: US 9,869,006 B2
(45) Date of Patent: Jan. 16, 2018

(54) INTERMETALLIC COMPOUND ULTRAFINE PARTICLE REINFORCED METAL-BASED COMPOSITE MATERIAL AND PREPARATION METHOD THEREOF

(71) Applicant: BEIHANG UNIVERSITY, Beijing (CN)

(72) Inventors: Guoqing Wu, Beijing (CN); Qingqing Zhang, Beijing (CN); Zhiyan Li, Beijing (CN); Zheng Huang, Beijing (CN)

(73) Assignee: BEIHANG UNIVERSITY, Beijing ( * ) Notice: Subject to any disclaimer, the term of this patent is extended or adjusted under 35 U.S.C. 154(b) by 222 days.

(21) Appl. No.: 14/375,034

(22) PCT Filed: May 31, 2013

(86) PCT No.: PCT/CN2013/076529
§ 371 (c)(1),
(2) Date: Jul. 28, 2014

(87) PCT Pub. No.: WO2014/063492
PCT Pub. Date: May 1, 2014

(65) Prior Publication Data

US 2015/0225814 A1 Aug. 13, 2015

(30) Foreign Application Priority Data

Oct. 25, 2012 (CN) ..... 2012 1 0414648

(51) Int. Cl.
*C22C 1/02* (2006.01)
*C22C 1/04* (2006.01)
(Continued)

(52) U.S. Cl.
CPC ..... *C22C 1/0491* (2013.01); *C22C 1/02* (2013.01); *C22C 1/026* (2013.01); *C22C 1/0416* (2013.01);
(Continued)

(58) Field of Classification Search
None
See application file for complete search history.

(56) References Cited

U.S. PATENT DOCUMENTS 5,093,148 A * 3/1992 Christodoulou ..... B22F 3/23 219/118
5,422,066 A * 6/1995 Webster ..... C22C 21/06 148/415
2009/0041609 A1 2/2009 Duz et al.

FOREIGN PATENT DOCUMENTS

JP 4083660 A * 9/1996

* cited by examiner

*Primary Examiner* — Jessee Roe
*Assistant Examiner* — Ngoclan T Mai
(74) *Attorney, Agent, or Firm* — Pai Patent & Trademark Law Firm; Chao-Chang David Pai

(57) ABSTRACT

This invention disclosed a method for preparing the ultrafine intermetallic particles reinforced metal matrix composites (MMC). The particle size of ultrafine intermetallic particles is about 0.01~5 μm. In this method, intermetallic particles and metal matrix were first ball milled together to get the mixed powder. Then, powders were cold-pressed then vacuum melting with metals to prepare the reinforced metal matrix composites materials. The intermetallic particles addition amount in this is 1~30 wt %. This invention improve the dispersion properties of intermetallic particles while increase the particle/matrix interface strength. The ultrafine intermetallic particles reinforced MMC shows the very good performance with good ductility and strength.

8 Claims, 3 Drawing Sheets

(51) Int. Cl.

| | |
|---|---|
| ***C22C 21/00*** | (2006.01) |
| ***C22C 23/00*** | (2006.01) |
| ***C22C 21/06*** | (2006.01) |
| ***C22C 24/00*** | (2006.01) |
| ***C22C 1/10*** | (2006.01) |

(52) U.S. Cl.

CPC ..... *C22C 1/1084* (2013.01); *C22C 21/00* (2013.01); *C22C 21/06* (2013.01); *C22C 23/00* (2013.01); *C22C 24/00* (2013.01)

INTERMETALLIC COMPOUND ULTRAFINE PARTICLE REINFORCED METAL-BASED COMPOSITE MATERIAL AND PREPARATION METHOD THEREOF

FIELD OF INVENTION

This invention is used in metal matrix composite field, introducing a manufacturing method for an intermetallic particles reinforced metal matrix composites. A mix-milling technique is used in this invention to modify ultrafine intermetallic particle surface in this MMC composites.

BACKGROUND OF THE INVENTION

Mg—Li based alloy has low density (1300~1600 kg/m$^3$), high specific strength and stiffness, good damping capacity and excellent electromagnetic shielding properties, as one of the lightest non-toxic metallic materials they are widely used in aerospace, transportation applications. In the binary Mg—Li alloy system, by increase of Li to certain amount, a series of phase transformation will take place as: $\alpha(hcp)\rightarrow\alpha+\beta\rightarrow\beta$ (bcc), see FIG. 1. These phase transformation can improve alloy ductility as the alloy elongation will increase about 40%. However, Mg—Li alloy has low strength and creep resistance, which limits the application of Mg—Li alloys.

The composite strengthening approach is probably the feasible way to increase strength and to prevent mechanical properties degradation of Mg—Li alloys. Compared with Mg—Li-based alloys, composites can maintain alloy's own properties such as good electrical conductivity, thermal conductivity, excellent cold and hot processing performance, low density, high specific stiffness, high specific strength, good wear, high temperature resistance, excellent damping properties and electromagnetic shielding performance, the alloy strength and creep resistance has largely improved. Hence, Mg—Li composites have became one of the most popular materials used in many applications. Like other composites, three main strengthening methods used in Mg—Li alloy are: fibers, whiskers, and particles strengthening, and the strengthening materials are SiC, $B_4C$, $Al_2O_3$, TiC and B. These strengthening materials can be used in Mg—Li alloy singly or coupled together, e.g SiC particles/$Al_2O_3$ whiskers mixed, to improve Mg—Li alloy mechanical properties. Although the Mg—Li alloy composites have excellent mechanical properties, some material ductility and elongation were sacrificed. Research results show that, the wetting properties and chemical compatibility between Mg—Li alloy and ceramics are very good to form an ideally alloy/ceramic interface, and the ductility of the ceramics has large impact on composites ductility and plasticity. Hence, to choose a ceramic with certain stain change capability in Mg—Li composites has large influence on material properties.

Intermetallics materials have some metallic material properties such as the metallic colour, electrical conductivity and thermal conductivity, hence they are be choose as the strengthening materials used in Mg—Li composites to form a good wetted and high chemical compatibility interface. In additions, intermetallic material has excellent specific strength and toughness, they can be used in high temperatures. Compared to ceramic reinforced composites material, using intermetallics as the strengthener can also improve composites plasticity and ductility, it can be a very good strengthener materials used in Mg—Li composites applications.

Patent No. 200910082581.7 mentions an ultrafine rare earth intermetallic compounds reinforced metal matrix composites. This composite using the reinforced intermetallic particles with particle size around 0.1~3 μm, the materials has excellent plasticity and the tensile strength was increased by 20%~40%. Although the composites has good properties, but the small intermetallic particles in composites are easily clusters and agglomerations with poor metal/intermetallic interface interfacial bonding, therefore, high performance rare earth intermetallic compounds reinforced Mg—Li composites are required.

SUMMARY OF THE INVENTION

This invention provides a preparation method for an ultrafine intermetallic particle reinforced MMC (metal matrix composite). It includes many steps such as mix-milling, pre-compressing and vacuum melting, thus solving the agglomeration problem of intermetallic particles and largely improving the mechanical properties of MMC.

In the fabrication process, the reinforced intermetallic particles were grinded with metal matrix in a ball mill to make the mix powder, which can modified the intermetallic particles surface properties, later, pre-compressed the mix powder into blocks. At last, add 1~30 wt % intermetallic particles into the metal and vacuum melted them together under mechanical and ultrasonic stirring to get the final ultrafine intermetallic particles reinforced MMC.

This invention provides a fabrication method of ultrafine intermetallic particle reinforced metal matrix composite, which reinforced with ultrafine intermetallic particles with particle size of around 0.01~5 μm, 1~30 wt %, The composites with optimum mechanical properties were achieved using reinforcement particles with average particle size of around 0.01~0.5 μm and 1~20 wt %, the preparation methods as follows:

Step 1, the reinforcement intermetallic particles and a metal additive were grinded are ground together using a planetary ball mill to get the mixed composite powder.

The alloy addition can be magnesium-based metal shavings or powder, aluminum metal shavings or powder. Because the Mg—Li alloy can oxidize easily, therefore it is not suitable to be used as powder form, in this invention, Mg—Li alloy is used as matrix, while the Mg as an additive. The total mass of the matrix consists of the weight of metal additives and the weight of the melting matrix in the third step, and the mass ratio of metal additive particles and reinforcement were from 1:3 to 3:1.

Step 2, cold-pressed the composites powder to obtain a pre-pressed blocks, which can prevent the contamination of impurities and excessive gas when add ultra fine powder into matrix alloy reinforcement. The condition of pre-compacted is in the pressure of 1 MPa~20 MPa for 10 min.

Step 3, according to the chemical composition of the alloy matrix in MMC materials, calculating the amount of metal elements in the alloy matrix less the metal additive, then vacuum melting the pre-pressed blocks and alloy elements to get the final particle reinforced MMC materials, the amount of the ultrafine intermetallic particles in MMC material is 1-30 wt%.

The reinforcements materials can be a transition metal or rare earth metal compounds, such as $YAl_2$ or $CeAl_2$ ultrafine intermetallic particles.

The metal matrix can be magnesium alloy and aluminum alloy. The magnesium alloy used in matrix is a Mg-0.1~40 wt % Li alloy, and aluminum alloy used in matrix is a Al-0.1~15 wt % Li alloy.

This invention use the high specific strength and toughness and size effect of the ultrafine particles strengthener to reinforced the metal, it also use the metallic and covalent bonding in intermetallics to form a direct bonded interface. The planet ball mill, mechanical and ultrasonic stirring are used to grind the mixed powder of intermetallics and metals, modifying the surface properties of intermetallics particles for better particles dispersion and interface bonding. Because the modification the composites microstructures and strengthening mechanisms, the ultrafine intermetallic particle reinforced MMC has a high strength and ductility than normally MMC materials.

The advantages of the present invention are as followed:

1. After the mix-milling process, the intermetallic compounds particles surface were modified, which influence the particle surface activities and increase the wettability between particles and metal matrix. Hence better dispersion of intermetallic particles in metal was achieved.
2. Compared with large size particles, particles with sub-micro and nanometer size showed different strengthening properties in metals. The improvement of mechanical properties of metal reinforced by particles was very significant when the particles size was very small.
3. Pressing the mix-milled powders into blocks, and then adding those blocks into molten metals for sufficient mixing of intermetallic compounds with metal matrix. The metal additives are melt firstly and let the intermetallic compounds particles to be uniformly dispersed, hence to enhance the process reliability and security.
4. Compared with the preparation techniques published before, this new melting process including many steps, such as particles surface modification, pre-compress powder, mechanical stirring using ultrasonic systems, which influence the composite materials strength and plasticity.
5. According to the preparation methods in this invention, the strength and the tensile strength of the composite materials is increased by 50% and 250% with the elongation is only reduced by 7%, therefore, very obvious strengthening effect but only sacrifice some plasticity of those intermetallic compound particles reinforced MMC,

DESCRIPTION OF THE PREFERRED EMBODIMENTS

Figure 1:
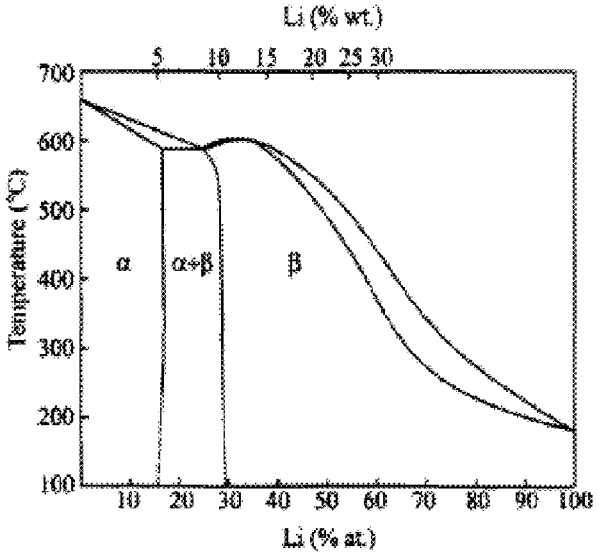
FIG. 1 Binary Mg—Li alloy phase diagram.
Figure 2:
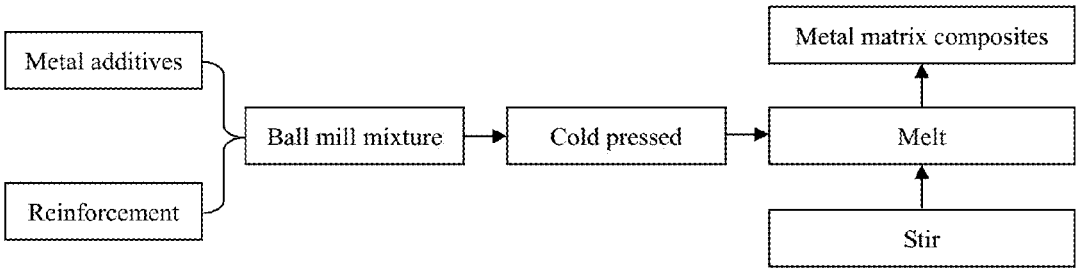
FIG. 2 The sketched fabrication process ultrafine particle reinforced metal matrix composites in this invention.

By referencing to the attached drawings and examples, the present invention is clarified in details:

The present invention provides a fabrication process of intermetallic compound ultrafine particles reinforced metal matrix composites, and the sketched diagram of fabrication process of this MMC is shown in FIG. 2. The details are as follows:

(1) The reinforcement intermetallic particles and metal additives were firstly mixed. Then the mixed powder was milled in a planetary ball mill to form a mixed composite powder. The reinforcement intermetallic particles, 0.01~5 μm in diameter, can be the transition or rare earth intermetallic particles, such as $YAl_2$ or $CeAl_2$. The metal additives were powders of magnesium, aluminum, or pure metal.

(2) The mix-milled composite powder was pre-compacted in 1MPa~20MPa conditions to obtain pre-compressed blocks. The process of pre-compaction can prevent introducing excessive gas impurities and combustion when adding the ultrafine powder into the alloy matrix to reinforce the resultant MMC.

(3) Pre-compressed blocks of the mixed composite powder were added into the melting metal matrix in melting process. Argon was used as the protection gas in this process. With the aid of mechanical and ultrasonic stirring, the reinforced metal matrix composites were prepared. The amount of metal elements in the metal additive should be accounted for when distributing the ratio of metal elements of the alloy matrix in the resultant MMC. In accordance with the requirements of the components of the alloy matrix in the reinforced metal matrix composites, the remaining amount of metal elements were added and melted into a melting metal matrix. Then pre-compressed blocks were added to the melting metal matrix. The amount of the prepared reinforcement intermetallic particles was 1-30 wt % in the reinforced metal matrix composites. The mechanical and ultrasonic stirring can help better dispersion of ultrafine particles, and to optimize the mechanical properties of the reinforced metal composites.

The matrix described is magnesium alloys or aluminum alloys.

The radius and the weight percentage of reinforcement particles in the metal matrix composites are 0.01~5 μm, and 1~30 wt %, respectively. During the preparation process, the blocks with modified ultrafine reinforcement particles and metals additives were meted with remaining metals to avoid powders clusters for better dispersion. The results of the particles/metal interfacial microstructure and the mechanical properties of the composites show that: The intermetallic particles were uniformly distributed in metal, and a very strong metallic bond was formed between reinforced particles and metal alloys; the tensile strength of composites were improves while with acceptable plasticity. This will be explained in details in following examples:

EXAMPLE 1

The following is a description of the method for processing of the Mg-14Li—Al matrix composites with reinforced ultrafine particles $YAl_2$ through stirring casting technique.

1. The monolithic $YAl_2$ intermetallic were prepared in advance using molten technique under 1530° C. with 37.76 wt % Al and balance with Y, then the $YAl_2$ were grinded down to powders (the mean size approximate to 5 microns) using mechanical crushed followed by high energy ball mill.

Powder mixtures of Mg-66.7 wt. % $YAl_2$ ($YAl_2$ is 600 g, Mg is 300 g) were milled together in a planetary ball mill in air at room temperature for 2 hrs.

2. After mixing, the Mg—$YAl_2$ powder mixture was cold-compacted to a bulk in a steel die set under 20 MPa.

3. The powder compacts be added to the alloy melt, an Mg—Li—Al (composition in mass (g): 224 Li, 16 Al, 890

Mg) matrix metal and 30 wt % of $YAl_2$ were casted together in a low carbon steel crucible.

The test results show that, the tensile strength of $YAl_2p$/MgLiAl composites at room temperature is 420 MPa, and increased by 200% than that of matrix alloy (122 MPa) with a good ductility and elongation higher than 7%.

EXAMPLE 2

The following is a description of the method for processing of the Mg-14Li—Al matrix composites with reinforced ultrafine particles $YAl_2$ through stirring casting technique.

1. The monolithic $YAl_2$ intermetallic were prepared in advance using molten technique under 1530° C. temperature and composition in mass %: 37.76 Al, balance Y, and then the $YAl_2$ powders (the mean size approximate to 0.01 microns) were prepared by mechanical crushed and high energy ball mill.

Powder mixtures of Mg-66.7 wt. % $YAl_2$ ($YAl_2$ is 20 g, Mg is 40 g) were milled together in a planetary ball mill under atmosphere at nominal room temperature for 2 hrs.

2. After mixing, the Mg—$YAl_2$ powder mixture was cold-compacted to a bulk in a steel die under 20 MPa for 10 mins.

3. The powder compacts be added to the alloy melt, an Mg—Li—Al (composition in mass (g): 227.2 Li, 19.8 Al, 1643 Mg) matrix metal and 1 wt % of $YAl_2$ were casted together in a low carbon steel crucible.

The test results show that, the tensile strength of $YAl_2p$/MgLiAl composites at room temperature is 320 MPa, and increased by 160% than matrix alloy (122 MPa). In addition, the elongation of composite is decrease from 20% to 18%.

Figure 3:
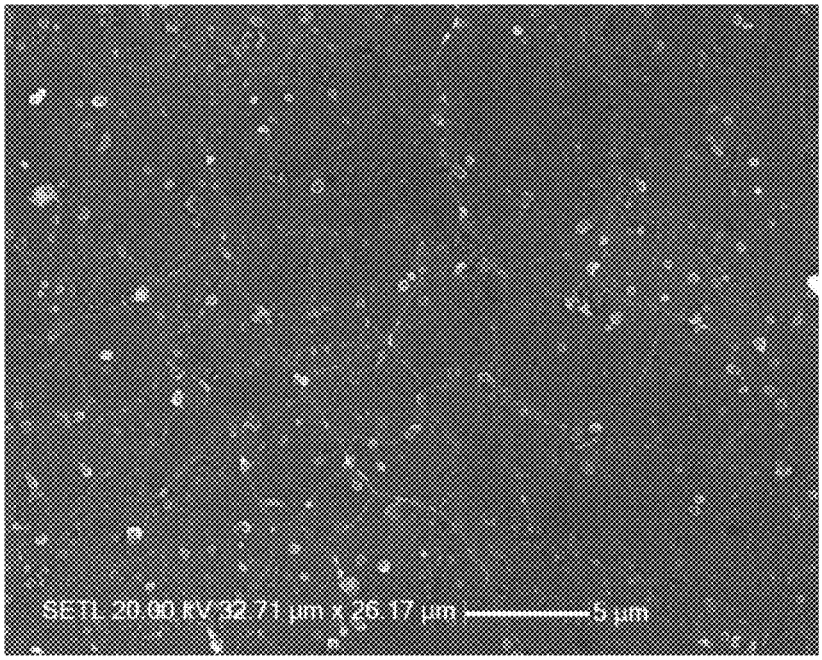
FIG. 3 Images of the interface characteristics of composites produced by the present invention FIG. 4 Microstructures of the composites FIG. 5 TEM image of $YAl_2$/Mg mixture during preparation process of the present invention.
Figure 4:
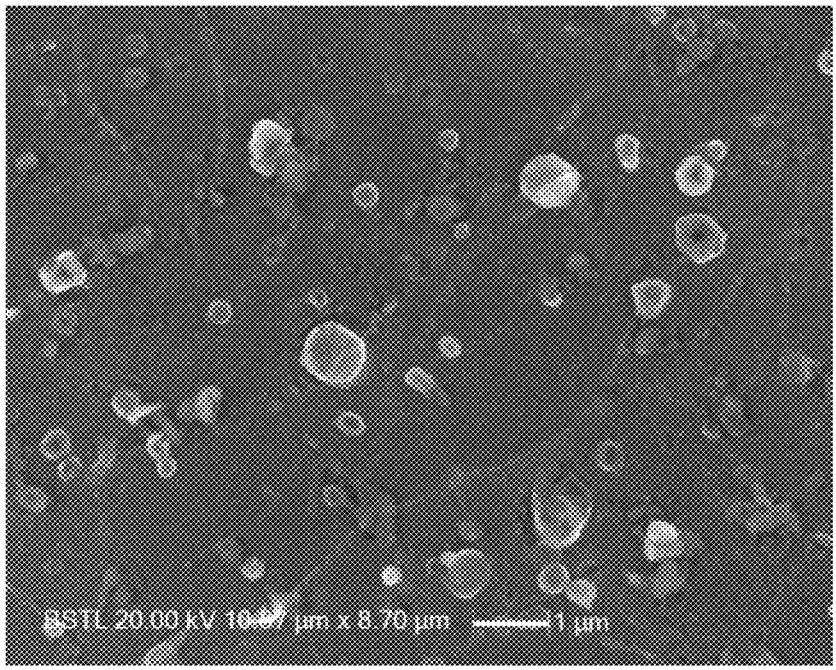
Figure 5:
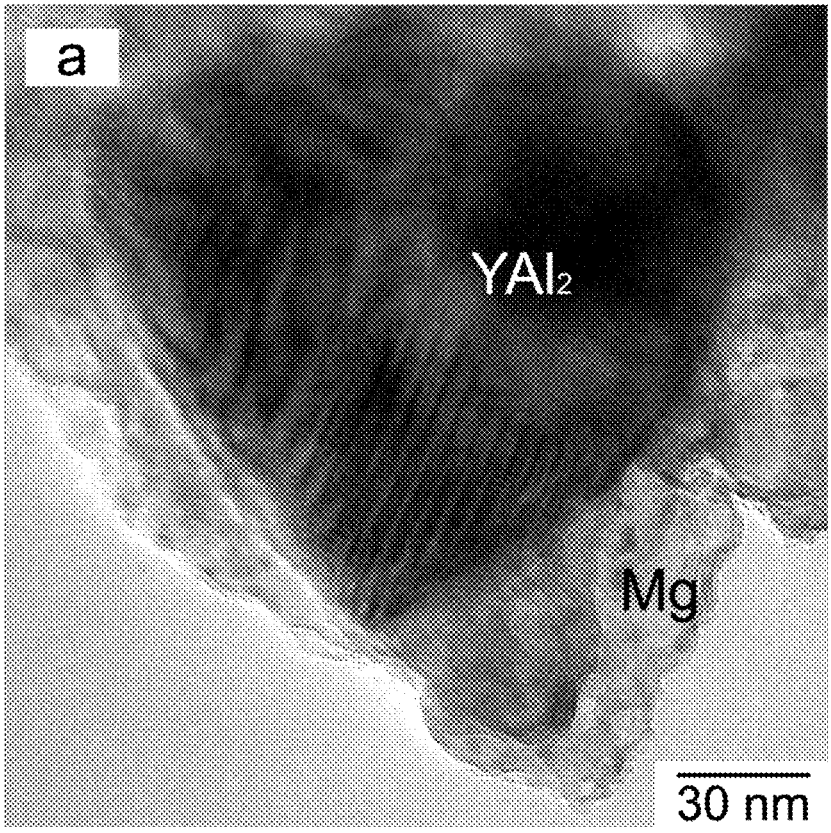

FIG. 3 and FIG. 4 is a microstructure of the composite. It can be seen that, the $YAl_2$ particles distributed uniformly in the Mg—Li—Al matrix and had no cluster observed. There is an ideal direct bonding interface formed between $YAl_2$ particles and Mg—Li matrix without interfacial interaction and de-bonding take place. The TEM photographs of the $YAl_2p$/Mg interface after mixing was shown in FIG. 5. Good metallurgical bonds are obtained between $YAl_2$ particles and magnesium. The $YAl_2$—Mg interface was bonded directly, free from any interfacial reactions products.

EXAMPLE 3

The following is a description of the method for processing of the Mg-14Li—Al matrix composites with reinforced ultrafine particles $YAl_2$ through stirring casting technique.

1. The monolithic $YAl_2$ intermetallic were prepared in advance using molten technique under 1530° C. temperature and composition in mass %: 37.76 Al, balance Y, and then the $YAl_2$ powders (the mean size approximate to 0.1 microns) were prepared by mechanical crushed and high energy ball mill. Powder mixtures of Mg-66.7 wt. % $YAl_2$ ($YAl_2$ is 20 g, Mg is 40 g) were milled together in a planetary ball mill under atmosphere at nominal room temperature for 2 hrs.

2. After mixing, the Mg—$YAl_2$ powder mixture was cold-compacted to a bulk in a steel die under 20 MPa for 10 mins.

3. The powder compacts be added to the alloy melt, an Mg-14Li—Al (composition in mass (g): 227.2 Li, 19.8 Al, 1643 Mg) matrix metal and 1 wt % of $YAl_2$ were casted together in a low carbon steel crucible.

The test results show that, the tensile strength of $YAl_2p$/MgLiAl composites at room temperature is 270 MPa, and increased by 120% than that of matrix alloy (122 MPa). In addition, the elongation of composite is decrease from 20% to 17%.

EXAMPLE 4

The following is a description of the method for processing of the Mg-14Li—Al matrix composites with reinforced ultrafine particles $YAl_2$ through stirring casting technique.

1. The monolithic $YAl_2$ intermetallic were prepared in advance using molten technique under 1530° C. temperature and composition in mass %: 37.76 Al, balance Y, and then the $YAl_2$ powders (the mean size approximate to 3 microns) were prepared by mechanical crushed and high energy ball mill.

Powder mixtures of Mg-66.7 wt. % $YAl_2$ ($YAl_2$ is 20 g, Mg is 40 g) were milled together in a planetary ball mill under atmosphere at nominal room temperature for 2 hrs.

2. After mixing, the Mg—$YAl_2$ powder mixture was cold-compacted to a bulk in a steel die set under 20 MPa.

3. The powder compacts be added to the alloy melt, a Mg-14Li-3Al (composition in mass g: 227.2 Li, 32.7 Al, 1630.1 Mg) matrix metal and 1 wt % of $YAl_2$ were casted together in a low carbon steel crucible.

The test results show that, the tensile strength of $YAl_2p$/MgLiAl composites at room temperature is 180 MPa, and increase over past 50% than that of matrix alloy (122 MPa) with a good ductility and elongation higher than 16%.

EXAMPLE 5

The following is a description of the method for processing of the Mg-40Li matrix composites with reinforced ultrafine particles $CeAl_2$ through stirring casting technique.

1. The monolithic $CeAl_2$ intermetallic were prepared in advance using molten technique under 1500° C. temperature and composition in mass %: 37.78 Al, balance Ce, and then the $CeAl_2$ powders (the mean size approximate to 1 microns) were prepared by mechanical crushed and high energy ball mill.

Powder mixtures of Mg-75 wt. % $CeAl_2$ ($CeAl_2$ is 300 g, Mg is 100 g) were milled together in a planetary ball mill under atmosphere at nominal room temperature for 2 h.

2. After mixing, the Mg—$CeAl_2$ powder mixture was cold-compacted to a bulk in a steel die set by using a pressure of 1 MPa.

3. The powder compacts be added to the alloy melt, a Mg-40Li (composition in mass g: 680 Li, 920 Mg in the alloy melt) matrix metal and 15 wt % $CeAl_2$ were casted together in a low carbon steel crucible.

The test results show that, the tensile strength of $CeAl_2p$/MgLi composites at room temperature is 180 MPa, and increase over past 150% than that of matrix alloy (70 MPa) with a good ductility and elongation higher than 20%.

EXAMPLE 6

The following is a description of the method for processing of the Al—Cu—Li matrix composites with reinforced ultrafine particles $YAl_2$ through stirring casting technique.

1. The monolithic $YAl_2$ intermetallic were prepared in advance using molten technique under 1530° C. temperature and composition in mass %: 37.76 Al, balance Y, and then the $YAl_2$ powders (the mean size approximate to 0.5 microns) were prepared by mechanical crushed and high energy ball mill.

Powder mixtures of 66.7 wt. % $Al_2Cu$ and 33.3 wt. % $YAl_2$ ($YAl_2$ is 20 g, $Al_2Cu$ is 40 g) were milled together in a planetary ball mill under atmosphere at nominal room temperature for 40 h.

2. After mixing, the $Al_2Cu$—$YAl_2$ powder mixture was cold-compacted to a bulk in a steel die under 20 MPa.

3. The powder compacts be added to the alloy melt, a Al—Cu—Li—Zr—Mn (composition in mass (g): 1873.3 Al, 27.9 Li, 33.1 Cu, 2.4 Zr, 3.3 Mn in the alloy melt) matrix metal and 1 wt % $YAl_2$ were casted together in a low carbon steel crucible.

The test results show that, the tensile strength of $YAl_2p$/MgLiAl composites at room temperature is 460 MPa, and increase over past 50% than that of matrix alloy (206 MPa). In addition, the elongation of composite is decrease from 17% to 15%.

The intermetallic having a high specific strength and stiffness, it can be used as effectively reinforcement material for magnesium-lithium alloy, aluminum-aluminum alloy and lithium alloy composites. Compared with the ceramics reinforcements, intermetallic have good wet properties due to the existence of the metallic bonds. The element Y, Ce and Al addition can improve materials wettability between the reinforced and matrix alloy. In addition, Al can improve composites strength, while Y and Ce can be as the grain refinerm therefore improve composites mechanical properties, anti-oxidation and creep deformation resistant. Compare to use ceramic as the strengthener, intermetallic reinforcement composites have good ductility and interfacial coherency, which inhibits the cracks propagation in composites. By the used of ultrafine intermetallic particles as the strengthener, the material strengthening mechanisms were changed, therefore, composites have better mechanical properties. As it was known, the strengthening efficiency was mainly dependent on the load transfer properties between the metal matrix composites and reinforced particles, the ultrafine particles reinforced MMC enhanced the dispersion hardening effect. Meanwhile, due to the reduce of particle size, the particle surface activity was increased, the bonding strength between particles and matrix are largely enhanced. Hence, the particles/matrix interfacial bonding strength, the particles dispersion ability and microstructure uniformly are the main reason to influence composites strength and ductility. According to the similarity properties of the rare earth compounds, the intermetallic strengthener also can use Sc—Al intermetallics, La—Al intermetallics and other intermetallics in MMC materials with excellent mechanical properties, they can be used in automobile, aerospace industries and other fields.

We claim:

1. A preparation method of an ultrafine intermetallic particle reinforced metal matrix composite (MMC), including the following steps:

Step 1: grinding reinforcement intermetallic particles and a metal additive together using a planetary ball mill to obtain a mixed composite powder with particle size 0.01-5μm;

Step 2: cold-pressing the mixed composite powder, at a pressure of 1-20 MPa, to obtain a pre-pressed block;

Step 3: vacuum melting the pre-pressed block and metal elements of an alloy to obtain the ultrafine intermetallic particle reinforced MMC, wherein the reinforcement intermetallic particles are uniformly dispersed in an alloy matrix comprising the metal elements of the alloy in Step 3 and the metal additive; and the amount of the reinforcement intermetallic particles in the ultrafine intermetallic particle reinforced MMC is 1-30 wt %.

2. The preparation method according to claim 1, wherein the reinforcement intermetallic particles are rare earth metal compounds.

3. The preparation method according to claim 1, wherein the alloy in Step 3 is a magnesium alloy or an aluminum alloy.

4. The preparation method according to claim 3, wherein the magnesium alloy is a Mg-0.1-40wt % Li alloy.

5. The preparation method according to claim 1, wherein the metal additive is magnesium-based metal shavings or powder, aluminum metal shavings or powder.

6. The preparation method according to claim 1, wherein the mass ratio of the metal additive and the reinforcement intermetallic particles are from 1:3 to 3:1.

7. The preparation method according to claim 2, wherein the reinforcement intermetallic particles are $YAl_2$ or $CeAl_2$.

8. The preparation method according to claim 3, wherein the aluminum alloy is a Al-0.1-15wt % Li alloy.

* * * * *